US008136851B2

(12) United States Patent
Nelson

(10) Patent No.: US 8,136,851 B2
(45) Date of Patent: Mar. 20, 2012

(54) ACCESS DOOR WITH INSIDE LATCH RELEASE

(75) Inventor: Norman D. Nelson, New Franklin, OH (US)

(73) Assignee: Babcock & Wilcox Power Generation Group, Inc.

( * ) Notice: Subject to any disclaimer, the term of this patent is extended or adjusted under 35 U.S.C. 154(b) by 535 days.

(21) Appl. No.: 12/357,743

(22) Filed: Jan. 22, 2009

(65) Prior Publication Data

US 2010/0181781 A1 Jul. 22, 2010

(51) Int. Cl.
*E05C 3/06* (2006.01)

(52) U.S. Cl. ..... 292/198; 292/341.17; 292/241; 292/256.73; 292/240

(58) Field of Classification Search ..... 292/198, 292/341.17, DIG. 47, 341.15, DIG. 20, 340, 292/DIG. 55, 216, 240, 241, 242, 194, 195, 292/197, 200, 206, 256, 256.5, 256.71, 256.73, 292/256.75, 92; 49/394, 141, 354
See application file for complete search history.

(56) References Cited

U.S. PATENT DOCUMENTS 472,938 A * 4/1892 Atherton ..... 292/207
566,184 A * 8/1896 Jauss ..... 292/258
1,028,452 A * 6/1912 Gates ..... 292/200
1,646,636 A * 10/1927 Baker ..... 292/256.73
1,666,945 A * 4/1928 Sekyer ..... 292/305
1,912,850 A * 6/1933 Kuck et al. ..... 292/256.75
2,150,851 A * 3/1939 Thompson ..... 292/158
2,177,942 A * 10/1939 Lang ..... 49/400
2,639,176 A * 5/1953 Montalbano ..... 292/58
2,746,782 A * 5/1956 Schamotta ..... 292/92
2,747,906 A 5/1956 Emmert
2,750,219 A * 6/1956 Bleam ..... 292/198
2,753,207 A * 7/1956 Forssell ..... 292/341.17
2,775,001 A * 12/1956 Baker ..... 454/214
2,849,250 A 8/1958 Williamson
2,966,864 A 1/1961 Weaver
3,151,903 A * 10/1964 Effner ..... 292/256.75
3,346,288 A * 10/1967 Cosentino ..... 292/92
3,424,339 A * 1/1969 Venable ..... 220/325
3,560,038 A * 2/1971 Gunther ..... 92/241
3,811,718 A * 5/1974 Bates ..... 292/241
3,936,086 A 2/1976 Berkowitz
4,303,264 A * 12/1981 Uehara ..... 292/7
4,331,354 A * 5/1982 Helding et al. ..... 292/92
4,372,591 A 2/1983 Cook et al.
4,803,808 A * 2/1989 Greisner ..... 49/394
5,197,226 A * 3/1993 Gayhart et al. ..... 49/394
5,462,249 A * 10/1995 Calzone ..... 248/316.7
5,741,031 A * 4/1998 Bauman et al. ..... 292/139
6,109,668 A * 8/2000 Demarco ..... 292/161
6,139,074 A * 10/2000 Barnett et al. ..... 292/240
6,412,834 B1 * 7/2002 Waitai et al. ..... 292/197
6,546,671 B2 * 4/2003 Mitchell et al. ..... 49/185

(Continued)

*Primary Examiner* — Thomas Beach
*Assistant Examiner* — Sajid R Ansari
(74) *Attorney, Agent, or Firm* — Eric Marich

(57) ABSTRACT

An apparatus and method providing a quick-release latch mechanism for a walled enclosure access door. The latch mechanism includes a striker with one end slidably inserted into the enclosure and the other end located outside the enclosure. A keeper is located within the enclosure and adapted to releasably engage and be captively held by the striker when the access door is in the closed position. If necessary, the access door can be readily unlatched from within the enclosure by manually rotating the keeper away from the enclosure wall to disengage and cause removal of the striker as the access door is being manually pushed open from within the enclosure.

32 Claims, 8 Drawing Sheets

U.S. PATENT DOCUMENTS 6,644,884 B2 * 11/2003 Gledhill ..... 403/317
7,168,576 B2 * 1/2007 Williams ..... 211/26
7,617,707 B2 * 11/2009 Chiang ..... 70/89
2002/0089190 A1 * 7/2002 Wang et al. ..... 292/251.5
2003/0026084 A1 * 2/2003 Lauchner ..... 361/826
2007/0158956 A1 * 7/2007 Wang et al. ..... 292/240
2011/0056139 A1 * 3/2011 Christensen ..... 49/395

* cited by examiner

ACCESS DOOR WITH INSIDE LATCH RELEASE

FIELD AND BACKGROUND OF THE INVENTION

The present invention relates generally to a door which is used to gain access to the interior of a steam generator and its related equipment, and more particularly to a door latch which can be quickly released by a person from within the steam generator or related equipment.

Access doors for steam generators and related equipment (e.g., flues, ducts, windboxes, hoppers, air heaters, penthouses, vestibules, precipitators, baghouses, scrubbers, etc.) are used to gain entry into the interior of the steam generator apparatus and related equipment. Installation and maintenance personnel need such access for movement of equipment and materials into and out of the steam generator and related equipment for installation, repair, and maintenance of the internal components and surfaces of the steam generator and related equipment.

The prior art steam generator access door constructions are not known to have been equipped with latch mechanisms which can be unlatched from within the steam generator.

The lack of providing steam generator access doors with a latch mechanism which is releasable from the inner side of the door has been due, in large part, to the harsh operating environment caused by the high temperature combustion product laden flue gas flowing through steam generators firing coal and other fossil fuels. These flue gases contain entrained products of combustion such as slag, ash, and/or soot which are deposited on the exposed surfaces of the steam generator.

A variety of latch mechanisms which can be released from the inside of a door have been provided for freezers, refrigerators and the like, where the interiors are kept under a relatively clean environment. Such latch mechanisms are of multipart construction whose parts are automatically returned to the normal operative position after the door has been opened from the inside. See for example, U.S. Pat. Nos. 2,747,906; 2,849,250; 2,966,864; 3,936,086; and 4,372,591.

Prior art latches which allow the opening of an access door from the indoor side are complex in construction and operation and may be difficult to manipulate in the dark and cramped quarters of a steam generator.

SUMMARY OF THE INVENTION

It is therefore a principal aspect of the present invention to provide a quick-release latch structure which is of simplified construction and operation.

A further aspect of the present invention is to provide an access door with an indoor latch release capable of withstanding the harsh environment of an operating fossil fuel fired steam generator.

Another aspect of the present invention is to provide a latch structure requiring only a turn of a latch handle from inside the access door to release the striker and allow the access door to be pushed open.

A further aspect of the present invention is to provide a rugged and durable latch structure including a striker releasable from inside the steam generator, and which is relatively inexpensive to fabricate and easy to assemble and manipulate.

The present invention is drawn to a steam generator access door latch mechanism structured for quick release, if necessary, from within the steam generator.

The quick-release latch mechanism must also be capable to withstand the harsh environment of an operating steam generator. The present invention accomplishes this by providing a latch mechanism which is simply comprised of two essential parts; i.e., a latch handle and a striker. Both the latch handle and the striker are disengaged and separately removed as the access door is being opened, and are manually returned to the normal operative position as the door is being closed. Thus, the latch handle and the striker are available for visual inspection and, if necessary, repair or replacement by maintenance personnel, each time that the access door is opened.

In accordance with this invention, there is provided a quick-release latch mechanism for use with an access door for a walled enclosure. The access door is pivotably mounted on a door frame for swinging between open and closed positions. The quick-release latch mechanism includes a striker having a proximal end located on the outer side of the door and a distal end slidably extending into the enclosure through a corresponding slot formed in the door frame. A keeper is located within the enclosure adjacent the inner side of the door and adapted to releasably engage and be captively held by the striker when the door is in the closed position. If necessary, the access door can be quickly unlatched from within the enclosure by manually rotating the keeper away from the enclosure wall to disengage and cause removal of the striker from the slot as the door is manually pushed open from within the enclosure.

The keeper is in the form of a latch handle having a forked cam at one end and a pistol-type grip at the other end. A catch pin is mounted in the forked cam end of the latch handle.

The striker is formed with a latching hook at its distal end and a pivotably mounted threaded member at its proximal end. The latching hook includes a notch shaped to receive the catch pin of the latch handle.

At least one yoke extends across the outer side of the access door, and has one end hinged to brackets secured to the door frame and the other end notched to engage the threaded member of the striker. A turning handle is threadably engaged with the threaded member at the proximal end of the striker to apply inward pressure to the exterior of the door by rotating the turning handle clockwise, while the door is in the closed position.

When the access door is in the closed position, the pistol-type grip of the latch handle abuts or bears against the enclosure wall, and the forked cam end and catch pin are engaged with the striker latching hook.

In accordance with the invention, if necessary, the access door can be readily opened, from within the enclosure, by manually rotating the latch handle away from the enclosure wall with an angle of rotation of about 90 degrees along a plane perpendicular to the wall to effect the release of the catch pin and disengagement of the latch handle from the striker latching hook thereby allowing the door to be manually pushed to the open position.

Accordingly, another aspect of the present invention is drawn to a method of latching and unlatching a walled enclosure access door for quick release from within the enclosure, the method comprising the steps of pivotably mounting the door on a door frame for swinging the door between open and closed positions; providing a latch handle inside the enclosure, the latch handle having a pistol-type grip at one end and a forked cam at the other end with a catch pin mounted therein; providing a striker with a latching hook at one end and a pivotable threaded member at the other end; inserting the latching hook end into the enclosure; positioning the latch handle with the pistol-type grip end abutting the inside of the enclosure wall and the catch pin engaging the latching hook; pushing the door to its closed position for engagement with the threaded member of the striker; applying inward pressure to the exterior of the door while the door is in the closed position; and, if necessary, unlatching the door from within the enclosure by rotating the latch handle away from the enclosure wall thereby causing the catch pin to disengage itself from the latching hook with the latching hook being removed from the enclosure as the door is being manually pushed open.

Another aspect of the invention involves the method of latching and unlatching a walled enclosure access door, wherein the step of unlatching the door includes rotating a quick-release latch handle 90 degrees from within the enclosure wall.

Yet another aspect of the invention involves the method of latching and unlatching a walled enclosure access door, including the step of forming a slot in the door frame such that the latching hook is free to move into and out of the enclosure.

Yet still another aspect of the invention involves the method of latching and unlatching a walled enclosure access door, including the step of mounting a yoke onto the door.

Still another aspect of the invention involves the method of latching and unlatching a walled enclosure access door, wherein the step of applying inward pressure to the exterior of the door includes meshing the yoke with the threaded member of the striker.

A further aspect of the invention involves the method of latching and unlatching a walled enclosure access door, wherein the step of meshing the yoke with the threaded member of the striker includes turning means threadably engaged with the threaded member of the striker.

A still further aspect of the invention involves the method of latching and unlatching a walled enclosure access door, including the step of rotating the turning means clockwise to apply inward pressure to the exterior of the door.

DESCRIPTION OF THE PREFERRED EMBODIMENT

Figure 1:
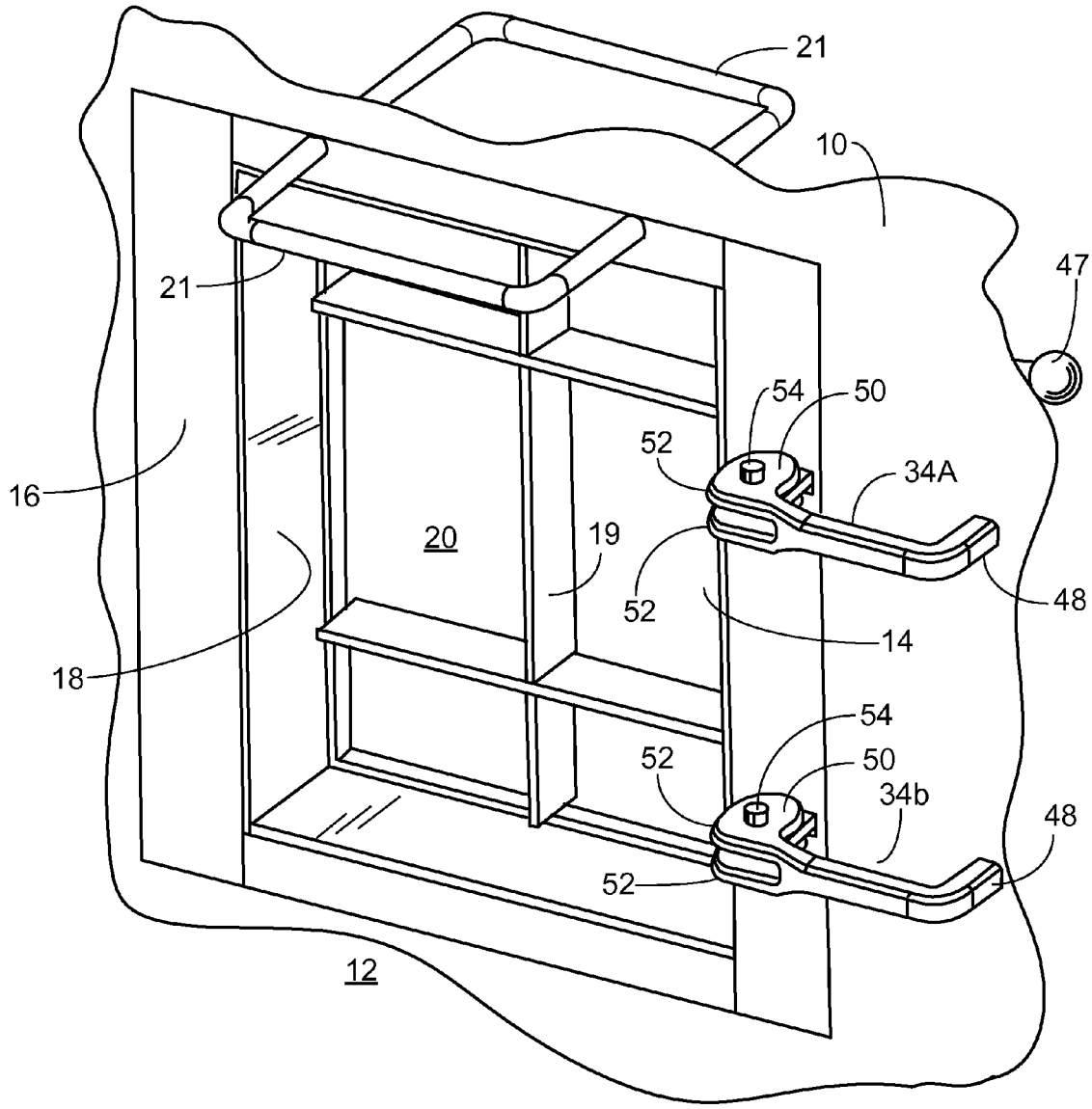
FIG. 1 is a perspective view of a closed access door equipped with the quick-release latch mechanism of the present invention in the latched state, as seen from the indoor side.

Referring to drawings, wherein like reference numerals designate the same or functionally similar elements throughout the several drawings, there is shown in fragmentary fashion an upright wall 10 of a steam generator enclosure or passageway 12 which is provided with a wall opening 14 through which access may be had to the interior of the enclosure 12. The opening 14 is of generally rectangular configuration, elongated in a vertical direction, and is defined by a door frame 16 provided in the upright wall 10. A door casing 18 is mounted on the door frame 16. A rectangular access door 20 overlaps the entire periphery of the casing 18 and is adapted to abut the casing 18 when the access door 20 is fully closed. The door 20 is reinforced by cross-stiffeners 19 affixed to the door side facing the interior of enclosure 12. Grab bars 21 are mounted on the door frame 16 inside and outside of the enclosure 12 for ease of exit from and entry into the enclosure 12.

Figure 2:
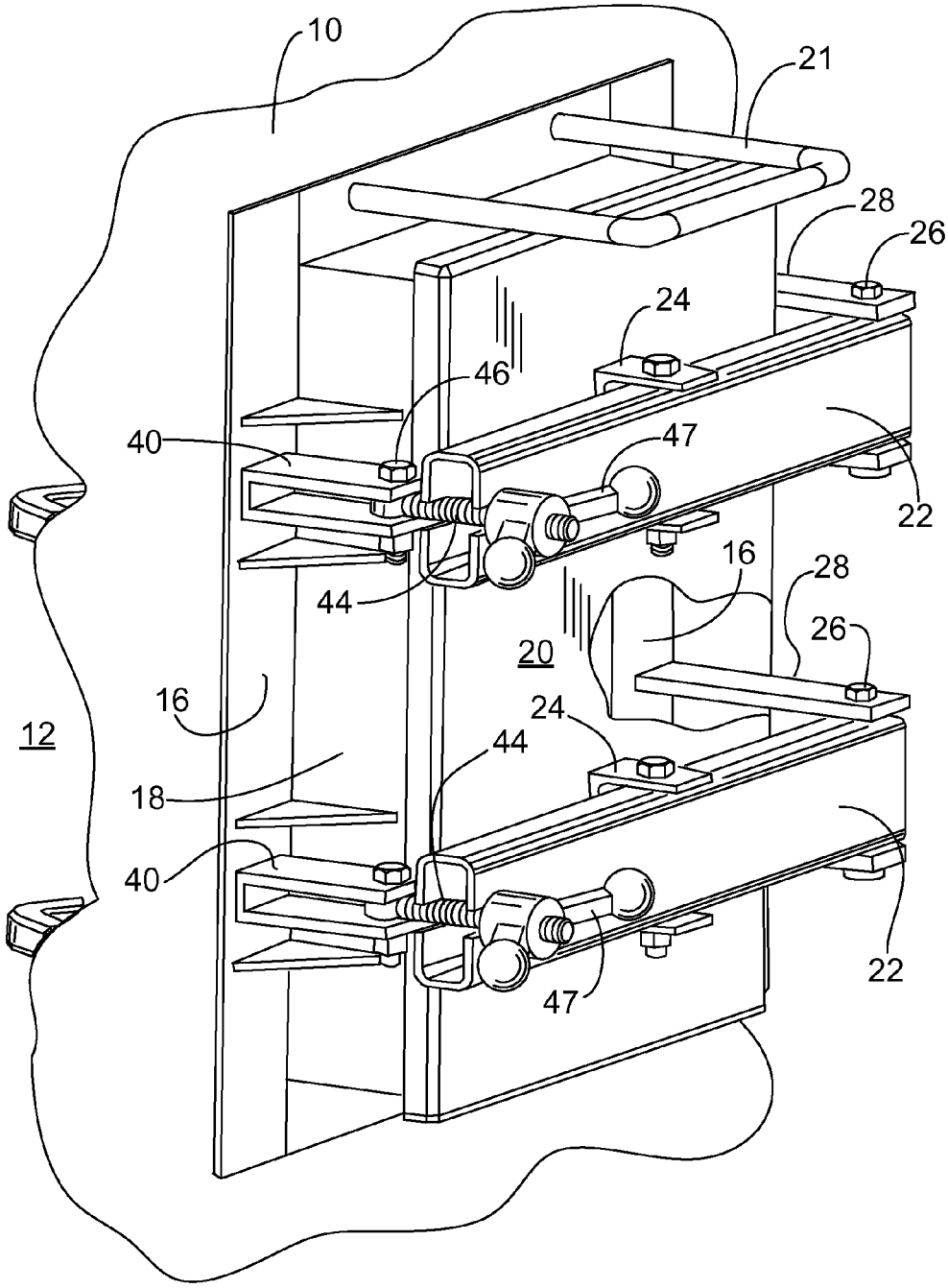
FIG. 2 is a perspective view of a closed access door equipped with the quick-release latch mechanism of the present invention in the latched state, as seen from the outdoor side.
Figure 5:
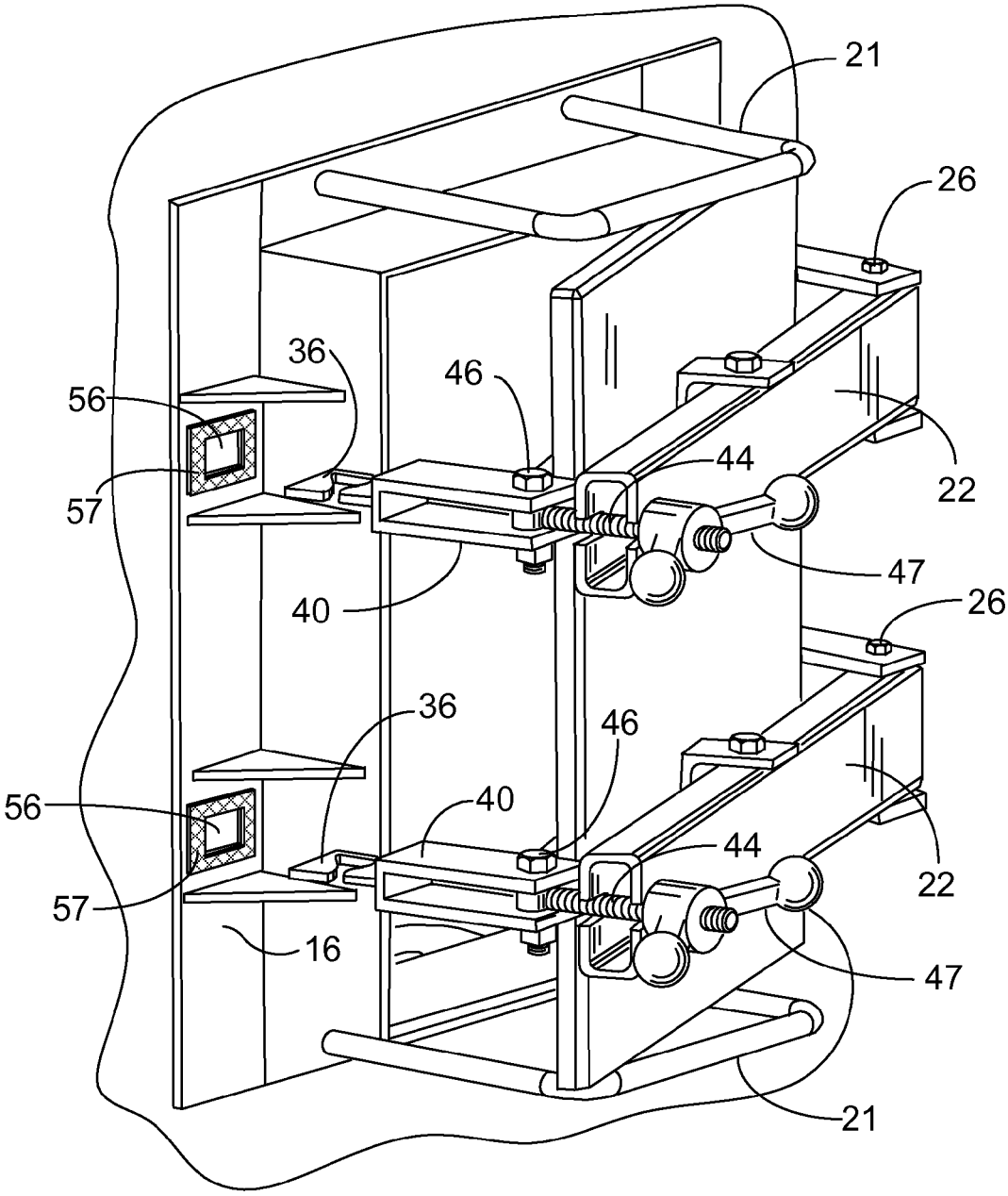
FIG. 5 is a perspective view of an access door equipped with the quick-release latch mechanism of the present invention in the unlatched state and in the process of being opened from the indoor side, as seen from the outdoor side.
Figure 6:
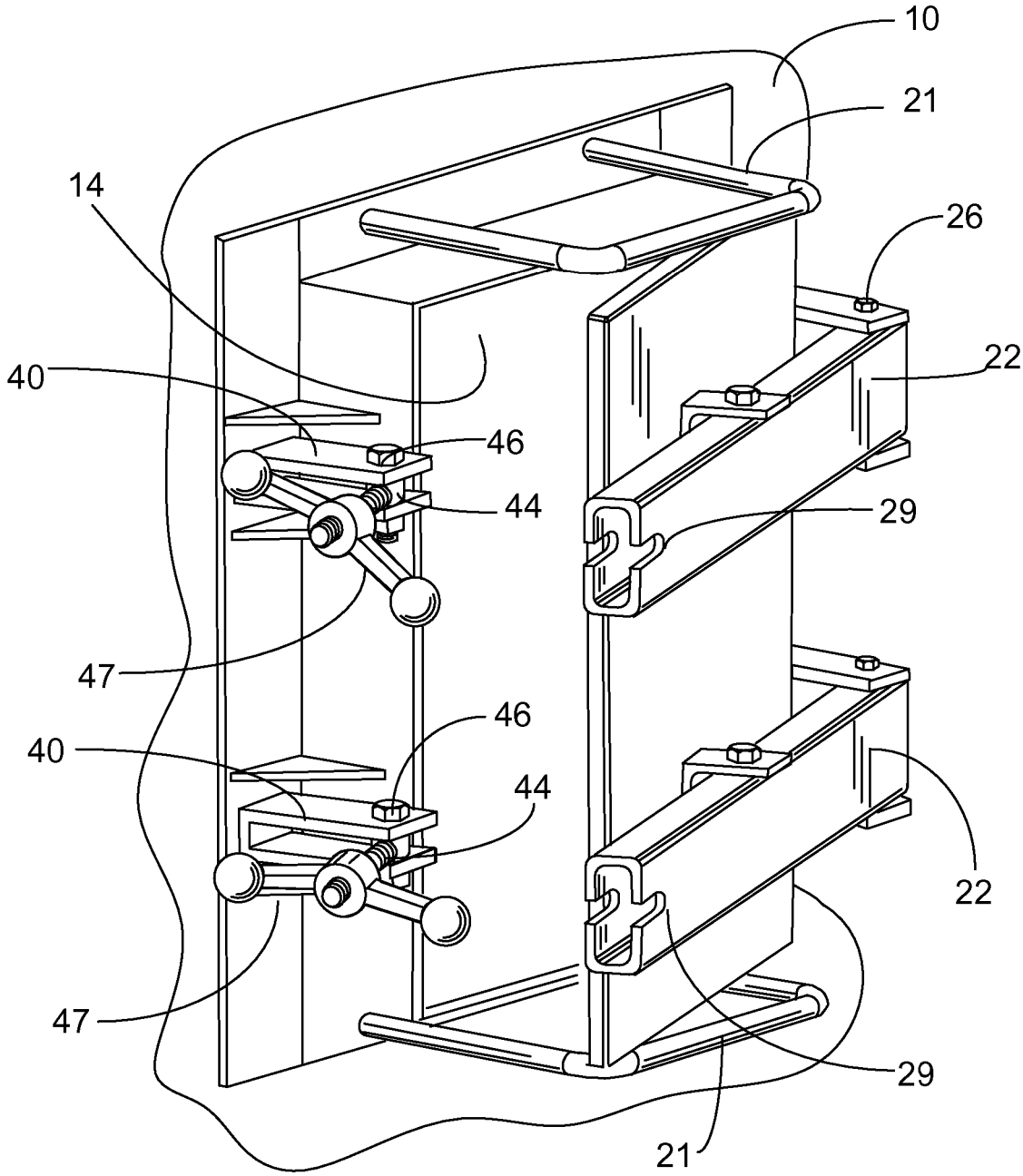
FIG. 6 is a perspective view of an access door equipped with the quick-release latch mechanism of the present invention in the unlatched state and in the process of being closed, as seen from the outdoor side.

A pair of spaced upper and lower parallel horizontal yokes 22, shown in FIGS. 2, 5 and 6, span the access door 20 and the door casing 18. The yokes 22 are in the form of rigid channel members having a generally rectangular cross-section, and are bolted to corresponding brackets 24 which are in turn fixedly attached to the access door 20. One end of each of the yokes 22 is hingedly secured about a corresponding pivot pin 26 mounted on a pair of support brackets 28 connected to the door frame 16. Thus, the opening and closing of the access door 20 is readily effected through movement of the yokes 22 about the pivotal axis of pins 26. Each of the yokes 22 is configured with a notch 29 at the other end, as shown in FIG. 6.

Figure 8:
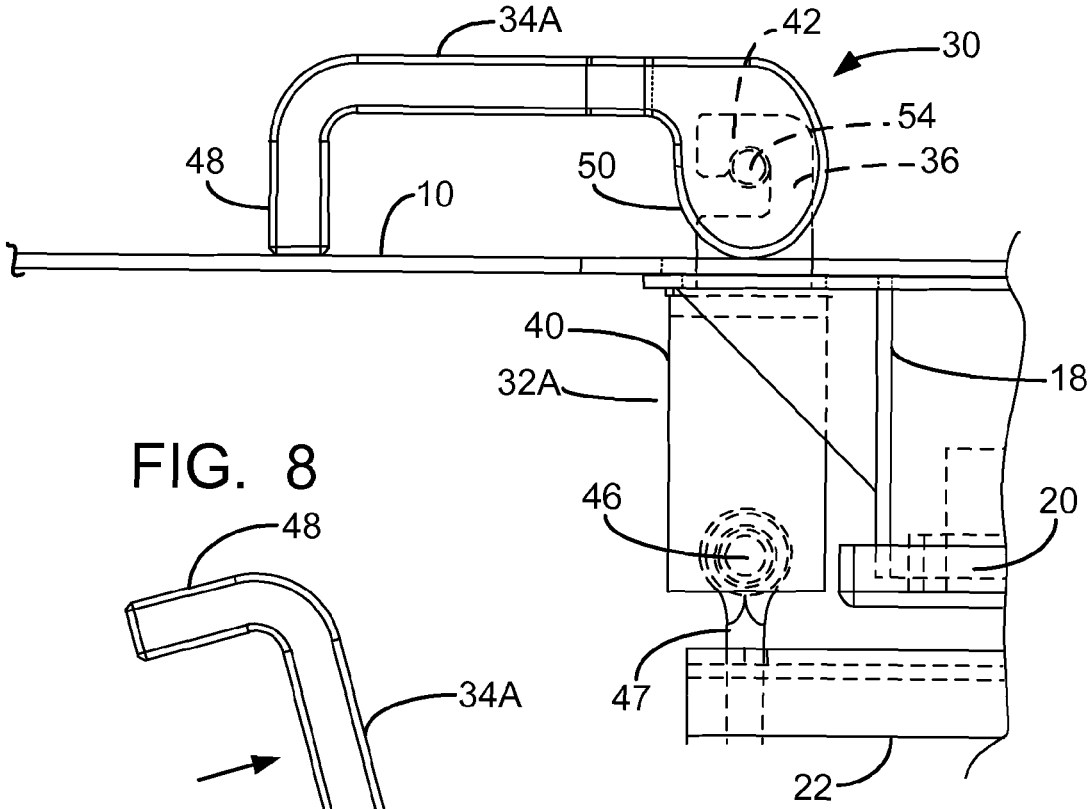
FIG. 8 is a cut away top view of the quick-release latch mechanism of the present invention in the latched state.
Figure 9:
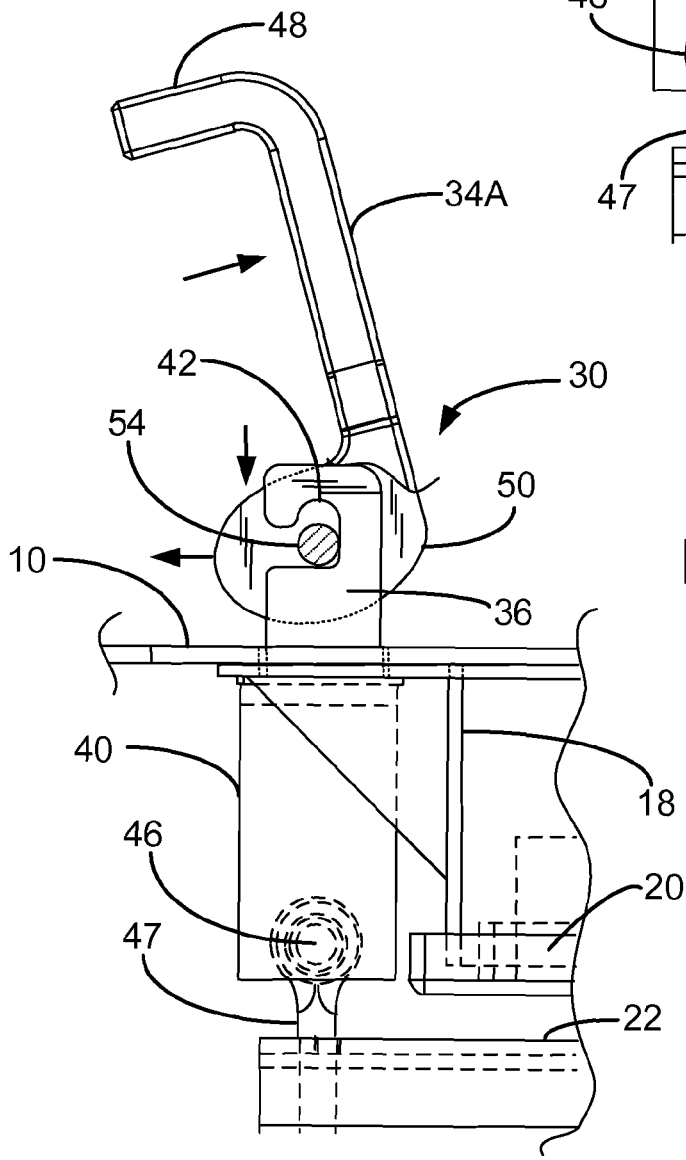
FIG. 9 is a cut away top view of the quick-release latch mechanism of the present invention in the process of being unlatched.

In accordance with the present invention, there is provided a quick-release latch mechanism 30, shown in FIGS. 8 and 9, with components thereof, particularly strikers 32A-B and keepers 34A-B being shown throughout the drawings.

The strikers 32A-B include a latching hook 36 formed at its distal end, and a coupler or clevis 40 formed at its proximal end. The latching hook 36 is configured with a notch 42 formed therein, and shown in FIGS. 8 and 9. The clevis 40 is pivotably connected to one end of a threaded member 44 by a pivot pin 46. A turning handle 47 is threadably engaged with the threaded member 44.

Each of the keepers or latch handles 34A-B is formed with a pistol-type grip 48 at one end and a forked cam 50 at the other end. The forked cam 50 includes a pair of supporting legs 52 which are spaced sufficiently apart so as to pivotably straddle the corresponding latching hook 36 of striker 32A-B. A catch pin 54 is connected to the supporting legs 52 of the forked cam 50.

The following is a description of the operation of the access door latch mechanism 30 for quick release by a person from inside the steam generator enclosure or passageway 12. The process of unlatching the access door 20 from the inside of enclosure 12 is effected by manually rotating the latch handles or keepers 34A-B away from the enclosure wall 10 along a plane perpendicular to the wall 10 until the latch handles 34A-B are disengaged from the corresponding latch strikers 32A-B.

FIG. 1 shows the access door 20 in the closed position as seen from the inside of enclosure 12. Each of the of latch handles 34A-B has its pistol-type grip 48 abutting or bearing against the enclosure wall 10 and its forked cam legs 52 pivotably straddling the latching hook 36.

FIG. 2 shows the access door 20 in the closed position as seen from the outside of enclosure 12. The threaded members 44 of strikers 32A-B are engaged with the notched ends 29 of yokes 22. The turning handles 47 are rotated clockwise to apply inward pressure to the outer face or side of the closed access door 20, and to thus secure the door 20 in its closed position.

Figure 3:
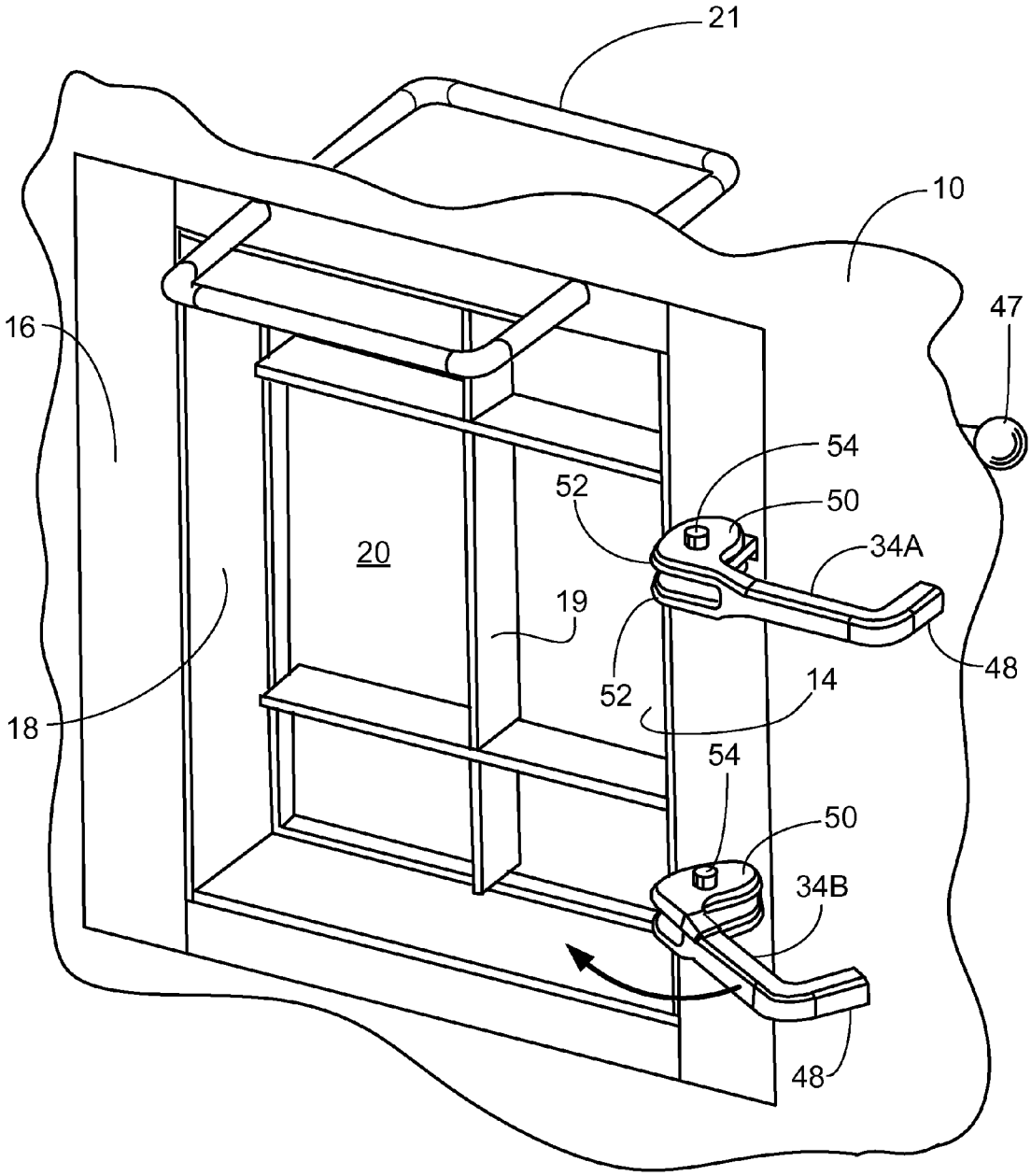
FIG. 3 is a perspective view of an access door equipped with the quick-release latch mechanism of the present invention in the process of being unlatched from the indoor side.

FIG. 3 shows the access door 20 in the process of being manually unlatched from the inside of enclosure 12. The upper latch handle 34A is in its engaged position with its pistol-type grip 48 abutting the enclosure wall 10 and its forked cam legs 52 pivotably straddled about the latching hook 36. The lower latch handle 34B is in the process of being manually disengaged from the latching hook 36 by the rotating of the pistol-type grip 48 away from the enclosure wall 10, thereby causing the cam-action of the forked cam 50 to disengage the catch pin 54 from the latching hook 36. The same procedure is followed in the manual disengagement of the upper latch handle 34A from the latching hook 36 in order to complete the unlatching of the access door 20.

Figure 4:
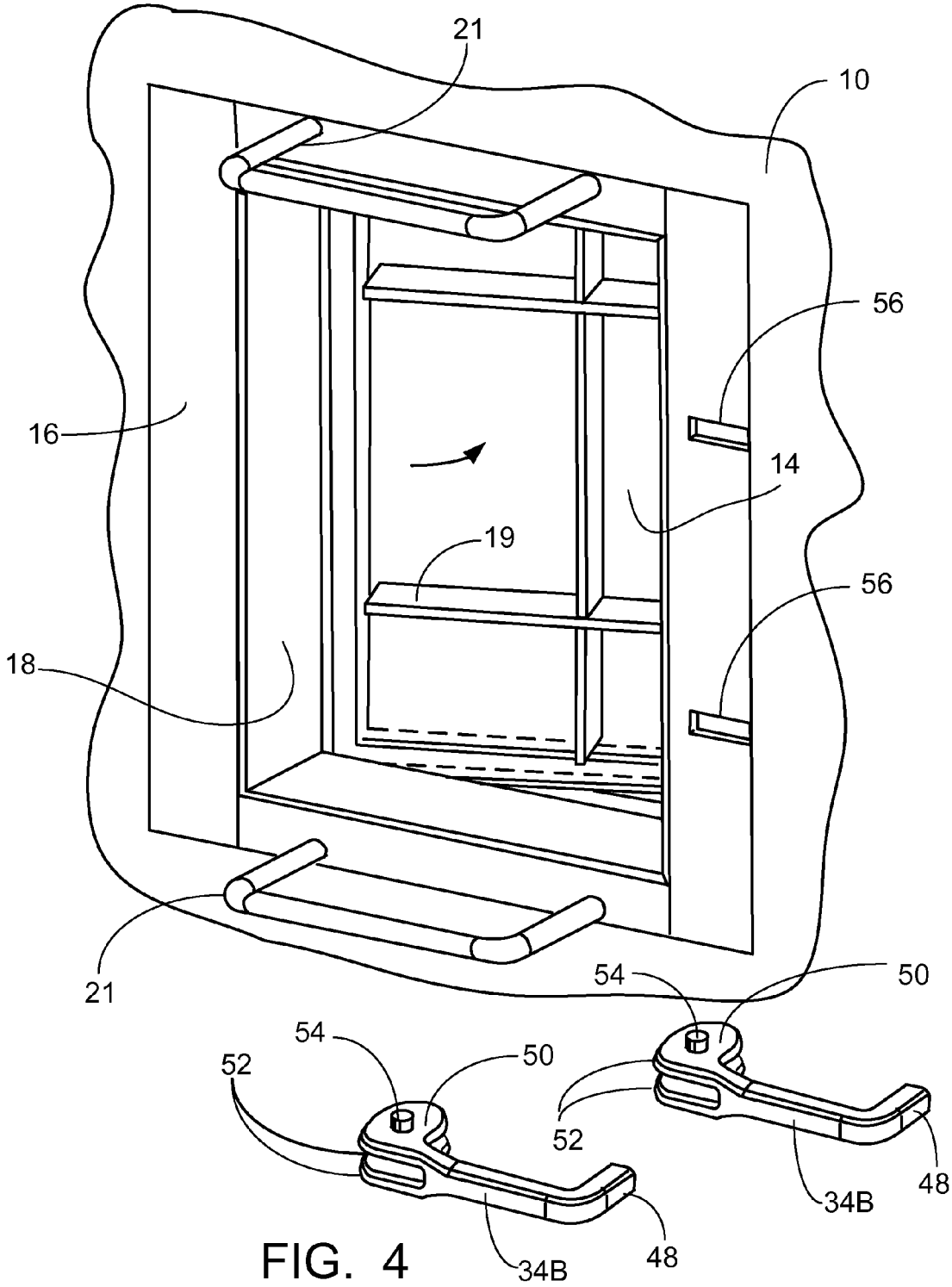
FIG. 4 is a perspective view of an access door equipped with the quick-release latch mechanism of the present invention in the unlatched state and in the process of being opened from the indoor side.

FIG. 4 shows the unlatched access door 20 as seen from the inside of enclosure 12. The access door 20 is partially open and on its way to being manually pushed to a fully opened position. The latch handles 34A-B have been manually disengaged from the respective latching hooks 36, thereby unlatching the access door 20.

FIG. 5 shows the unlatched access door 20 as seen from the outside of enclosure 12. The access door 20 is partially open and on its way to being manually pushed to a fully opened position. The latch hooks 36 are forced out of the enclosure 12 through the door frame slots 56 as the latch strikers 32A-B are moved along with the access door 20 which is being pushed open from the inside of enclosure 12. In order to seal against leakage of hot air or gases through the frame slots 56, a resilient, high-temperature gasket 57 is provided for each frame slot 56 as shown. By being resilient or slightly compressible, the gaskets 57 provide a positive "feel" or indication as the cam-action engagement of the latch handles 34A and 34*b* to the latching hooks 36 takes place.

FIG. 6 shows the access door 20 in the process of being manually closed, as seen from the outside of enclosure 12. In order to close and latch the access door 20, the latching hooks 36 of latch strikers 32A-B are slidably inserted through door frame slots 56 into the enclosure 12, and the turning handles 47 and the threaded member 44 are pivoted clear of the closing path of the access door 20.

Figure 7:
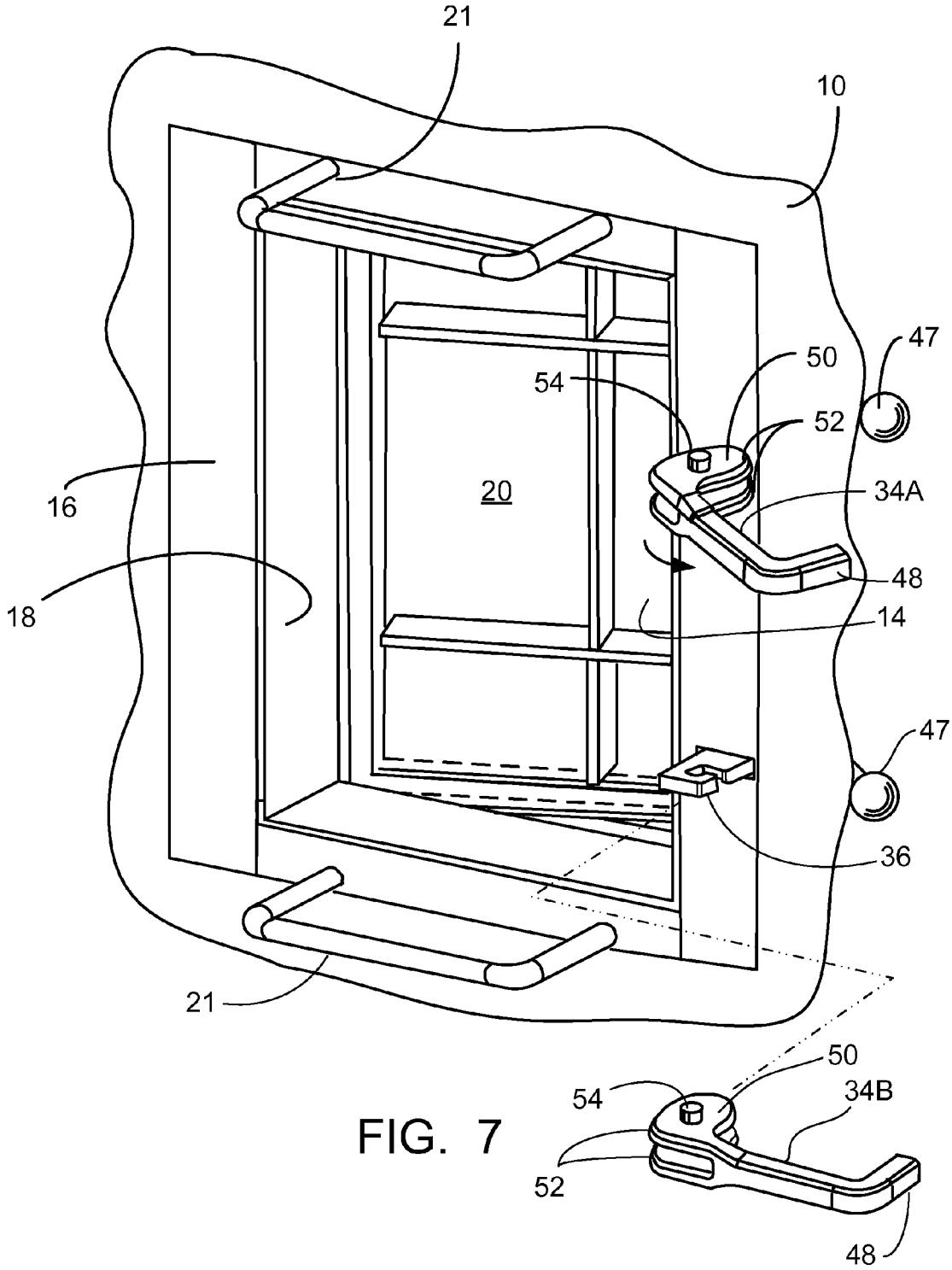
FIG. 7 is a perspective view of an access door equipped with the quick-release latch mechanism of the present invention in the process of being latched, as seen from the indoor side.

FIG. 7 shows the access door 20 in the process of being closed, as seen from the inside of enclosure 12. The latch handles 34A-B are manually placed into the enclosure 12 through the open access door 20. The latch handle 34A is being positioned so as to have the forked cam legs 52 pivotably straddling the latching hook 36 with the catch pin 54 resting in the latching hook notch 42, and the pistol-type grip 48 being turned such that it will abut the enclosure wall 10, as shown in FIGS. 1 and 3. The same procedure is followed in the manual engagement of the lower latch handle 34B with the latching hook 36. After the access door 20 is pushed to its closed position, the turning handles 47 and the threaded members 44 are pivoted to engage the yoke notches 29. With the access door 20 thus closed, the turning handles 47 are rotated to apply inward pressure on the exterior face or side of the access door 20, to secure the latching of the door 20 in its closed position, as shown in FIG. 2.

FIG. 8 shows the latching mechanism 30 in a latched position. The latch striker 32 has its latching hook 36 extending into the enclosure 12 and in latched engagement with the cam 50 of latch handle 34 whose catch pin 54 rests in the notch 42 of latching hook 36. The latch handle pistol-type grip 48 abuts the enclosure wall 10.

FIG. 9 shows the latching mechanism 30 in the process of being unlatched from the inside of enclosure 12. The rotating of the latch handle 34 about 90 degrees from the enclosure wall 10 along a plane perpendicular to the wall 10 causes the cam-action of the latch handle cam 50 to move the catch pin 54 out of the notch 42 of the striker latching hook 36. The thus unlatched handle 34 is manually removed from engagement with the latch striker 32.

Although the present invention has been described above with reference to particular means, materials, and embodiments, it is to be understood that this invention may be varied in many ways without departing from the spirit and scope thereof, and therefore is not limited to these disclosed particulars but extends instead to all equivalents within the scope of the following claims.

What is claimed is:

1. A quick-release latch mechanism for use with an access door for a walled enclosure, the door having inner and outer sides and being pivotably mounted on a door frame for swinging between open and closed positions, the latch comprising:

a striker having a proximal end located on the outer side of the door and a distal end slidably extending into the enclosure through a corresponding slot formed in the door frame, wherein the proximal end of the striker includes a threaded member pivotably mounted thereon;

a keeper located within the enclosure adjacent the inner side of the door and adapted to releasably engage and be captively held by the striker when the door is in the closed position, the keeper being manually operable from within the enclosure if necessary to unlatch the door and cause removal of the striker from the slot as the door is pushed open; and at least one yoke, wherein the at least one yoke is secured to the outer side of the door, the yoke having one end hinged to brackets secured to the door frame and the other end notched to engage the threaded section of the striker.

2. The latch mechanism of claim 1, wherein the keeper is a latch handle having a forked cam at one end and a pistol-type grip at the other end.

3. The latch mechanism of claim 2, including a catch pin mounted in the cam end of the latch handle.

4. The latch mechanism of claim 3, including a latching hook at the distal end of the striker.

5. The latch mechanism of claim 4, wherein the pistol-type grip bears against the inside of the enclosure wall and the forked cam end and catch pin are engaged with the latching hook when the door is in the closed position.

6. The latch mechanism of claim 4, wherein the latch handle is manually rotated away from the inside of the enclosure wall to release the catch pin from the latching hook thereby allowing the door to be pushed to the open position.

7. The latch mechanism of claim 4, wherein the latching hook includes a notch shaped to receive the catch pin.

8. A method of latching and unlatching a walled enclosure access door for quick release from within the enclosure, the method comprising the steps of:

pivotably mounting a door on a door frame for swinging between open and closed positions;

mounting a yoke onto the door;

providing a latch handle inside the enclosure, the latch handle having a pistol-type grip at one end and a forked cam at the other end with a catch pin mounted therein;

providing a striker with a latching hook at one end;

inserting the latching hook end into the enclosure;

positioning the latch handle with the pistol-type grip end abutting the inside of the enclosure wall and the catch pin engaging the latching hook;

pushing the door to its closed position for engagement with the other end of the striker;

applying inward pressure to the exterior of the door while the door is in the closed position; and if necessary, unlatching the door from within the enclosure by rotating the latch handle away from the enclosure wall thereby causing the catch pin to disengage itself from the latching hook with the latching hook being removed from the enclosure as the door is pushed open.

9. The method of claim 8, wherein the step of unlatching the door includes rotating the latch handle away from the inside of the enclosure wall.

10. The method of claim 8, including the step of forming a slot in the door frame such that the latching hook is free to move into and out of the enclosure.

11. A quick-release latch mechanism for use with an access door for a walled enclosure, the door having inner and outer sides and being pivotably mounted on a door frame for swinging between open and closed positions, the latch comprising:

a striker having a proximal end located on the outer side of the door and a distal end slidably extending into the enclosure through a corresponding slot formed in the door frame, wherein the proximal end of the striker includes a threaded member pivotably mounted thereon;

a keeper located within the enclosure adjacent the inner side of the door and adapted to releasably engage and be captively held by the striker when the door is in the closed position, the keeper being manually operable from within the enclosure if necessary to unlatch the door and cause removal of the striker from the slot as the door is pushed open; and a turning handle threadably engaged with the threaded member of the striker to apply inward pressure to the exterior of the door while the door is in the closed position.

12. The latch mechanism of claim 11, wherein the keeper is a latch handle having a forked cam at one end and a pistol-type grip at the other end.

13. The latch mechanism of claim 12, including a catch pin mounted in the cam end of the latch handle.

14. The latch mechanism of claim 13, including a latching hook at the distal end of the striker.

15. The latch mechanism of claim 14, wherein the pistol-type grip bears against an interior surface of the walled enclosure and the forked cam end and catch pin are engaged with the latching hook when the door is in the closed position.

16. The latch mechanism of claim 14, wherein the latch handle is manually rotated away from an interior surface of the walled enclosure to release the catch pin from the latching hook thereby allowing the door to be pushed to the open position.

17. The latch mechanism of claim 14, wherein the latching hook includes a notch shaped to receive the catch pin.

18. A method of latching and unlatching a walled enclosure access door for quick release from within the enclosure, the method comprising the steps of:

pivotably mounting the door on a door frame for swinging between open and closed positions;

mounting a yoke onto the door;

providing a latch handle inside the enclosure, the latch handle having a pistol-type grip at one end and a forked cam at the other end with a catch pin mounted therein;

providing a striker with a latching hook at one end;

inserting the latching hook end into the enclosure;

positioning the latch handle with the pistol-type grip end abutting the inside of the enclosure wall and the catch pin engaging the latching hook;

pushing the door to its closed position for engagement with the other end of the striker;

applying inward pressure to the exterior of the door while the door is in the closed position, wherein the step of applying inward pressure to the exterior of the door includes meshing the yoke with the striker; and if necessary, unlatching the door from within the enclosure by rotating the latch handle away from the enclosure wall thereby causing the catch pin to disengage itself from the latching hook with the latching hook being removed from the enclosure as the door is pushed open.

19. The method of claim 18, wherein the step of meshing the yoke with the striker includes turning means threadably engaged with the striker.

20. The method of claim 19, including the step of rotating the turning means clockwise to apply inward pressure to the exterior of the door.

21. The method of claim 18, wherein the step of unlatching the door includes rotating the latch handle away from the inside of the enclosure wall.

22. The method of claim 18, including the step of forming a slot in the door frame such that the latching hook is free to move into and out of the enclosure.

23. A quick-release latch mechanism for use with an access door for a walled enclosure, the door having inner and outer sides and being pivotably mounted on a door frame for swinging between open and closed positions, the latch comprising:

a striker having a proximal end located on the outer side of the door and a distal end slidably extending into the enclosure through a corresponding slot formed in the door frame; and a keeper located within the enclosure adjacent the inner side of the door and adapted to releasably engage and be captively held by the striker when the door is in the closed position, the keeper being manually operable from within the enclosure if necessary to unlatch the door and cause complete removal of the keeper from the striker and thus the complete removal of the distal end of the striker from the slot as the door is pushed open, wherein the proximal end of the striker remains coupled to the door.

24. The latch mechanism of claim 23, wherein the keeper is a latch handle having a forked cam at one end and a pistol-type grip at the other end.

25. The latch mechanism of claim 24, including a catch pin mounted in the cam end of the latch handle.

26. The latch mechanism of claim 25, including a latching hook at the distal end of the striker.

27. The latch mechanism of claim 26, wherein the pistol-type grip bears against the inside of the enclosure wall and the forked cam end and catch pin are engaged with the latching hook when the door is in the closed position.

28. The latch mechanism of claim 26, wherein the latch handle is manually rotated away from the inside of the enclosure wall to release the catch pin from the latching hook thereby allowing the door to be pushed to the open position.

29. The latch mechanism of claim 26, wherein the latching hook includes a notch shaped to receive the catch pin.

30. The latch mechanism of claim 23, wherein the proximal end of the striker includes a threaded member pivotably mounted thereon.

31. The latch mechanism of claim 30, including at least one yoke secured to the outer side of the door, the yoke having one end hinged to brackets secured to the door frame and the other end notched to engage the threaded section of the striker.

32. The latch mechanism of claim 30, including a turning handle threadably engaged with the threaded member of the striker to apply inward pressure to the exterior of the door while the door is in the closed position.

* * * * *